United States Patent [19]

Fung et al.

[11] 4,247,022

[45] Jan. 27, 1981

[54] APPARATUS FOR SUPPLYING MOLTEN BITUMINOUS MATERIAL

[75] Inventors: Ignatius Fung, 3325 Tallmast Crescent,, Mississauga, Ontario,, Canada, L5L 1K1; Robert W. Mason, 1476 Mississauga Rd., North, Mississauga, Ontario, Canada

[73] Assignee: Marathon Equipment Ltd., Weston, Canada

[21] Appl. No.: 54,587

[22] Filed: Jul. 3, 1979

[51] Int. Cl.[3] ..... B67D 5/62

[52] U.S. Cl. ..... 222/146 H; 141/115; 417/440; 417/442; 222/318; 222/385; 137/625.21;625.43;875

[58] Field of Search ..... 141/115, 116; 417/440, 417/442; 222/318, 424, 146 H, 146 HE, 385

[56] References Cited

U.S. PATENT DOCUMENTS

| | | | |
|---|---|---|---|
| 384,833 | 6/1888 | Faulkner . | |
| 620,770 | 3/1889 | Hanson . | |
| 1,585,951 | 5/1926 | Waller | 137/875 X |
| 2,279,566 | 4/1942 | Grant et al. . | |
| 3,076,509 | 2/1963 | Burns et al. . | |
| 3,285,282 | 11/1966 | Martin . | |

FOREIGN PATENT DOCUMENTS

| | | | |
|---|---|---|---|
| 98985 | 11/1921 | Switzerland | 417/440 |

*Primary Examiner*—David A. Scherbel
*Attorney, Agent, or Firm*—Ridout & Maybee

[57] ABSTRACT

An apparatus for supplying molten bituminous material to an elevated level in which the molten bituminous material is pumped by a pump through a valve and up an upstanding supply pipe to the elevated level the supply pipe is in communication through two ports of the valve with the interior of the vat for free draining under gravity of the body of bituminous material from the supply pipe back to the vat when the supply of molten bituminous material to the elevated level is discontinued. While the supply of molten bituminous material to the elevated level is discontinued the bituminous material is pumped through two further ports of the valve for recycling back into the vat, preferably at an end of the vat remote from the pump inlet in order to ensure substantially complete circulation of the molten bituminous material within the vat.

4 Claims, 3 Drawing Figures

APPARATUS FOR SUPPLYING MOLTEN BITUMINOUS MATERIAL

Figure 1:
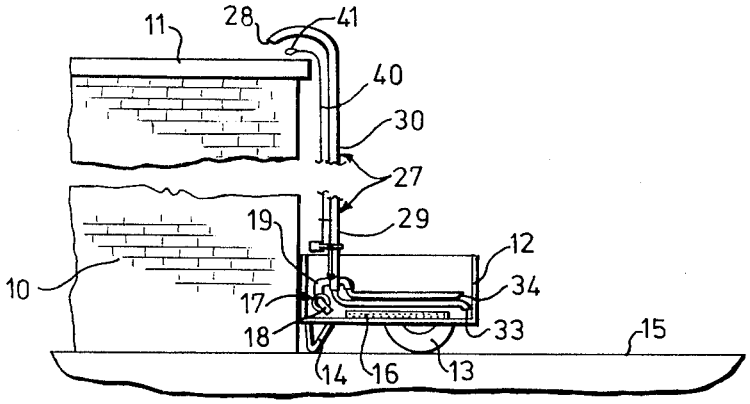

This invention is concerned with apparatus for supplying molten bituminous material, such as asphalt, to an elevated level, such as the roof of a building.

It is conventional for a roof of a building, and particularly such a roof which is of flat, horizontal form, to be provided with layers of roofing felt or other sheet material which are embedded in a layer or layers of bituminous material, such as asphalt. This involves supplying the bituminous material in a molten state to the roof of the building, and most conveniently this is achieved by disposing at ground level a vat within which there is provided a heater for melting the bituminous material loaded into the vat, a pump being provided for supplying the molten bituminous material from the vat up an upstanding supply pipe to the roof of the building.

In forming the layer or layers of bituminous material on the roof of the building it is, of course, generally required that the supply of molten bituminous material be periodically discontinued while, for example, further layers of the roofing felt or other sheet material are disposed in position. In order to provide for this discontinuous supply of the molten bituminous material to the roof of the building it is conventional for the molten bituminous material to pass through a valve which may be so controlled that, when it is desired to discontinue the supply of the molten bituminous material to the roof, the valve closes the lower end of the upstanding supply pipe and permits the molten bituminous material from the pump to be recycled into the vat. It is, however, a disadvantage of such apparatus that, when the supply of the molten bituminous material to the roof is discontinued, the body of bituminous material within the upstanding supply pipe cools with the result that, unless the supply of the bituminous material to the roof is discontinued for only a very short period of time, this body of bituminous material in the supply pipe may solidify. In this event, it is of course necessary before the supply of molten bituminous material to the roof can be recommenced for the body of solidified bituminous material in the upstanding supply pipe to be removed. This is a time consuming and costly operation. In an alternative form of this apparatus as hitherto used the operation of the valve to permit the molten bituminous material from the pump to be recycled into the vat when it is desired to discontinue the supply of the bituminous material to the roof does not result in closing of the lower end of the outstanding supply pipe. However, in this alternative form of apparatus as hitherto used the body of molten bituminous material in the supply pipe drains back into the flow of bituminous material through the valve from the pump. Accordingly, this draining of the body of bituminous material from the supply pipe is resisted by the flow of bituminous material through the valve from the pump for recycling into the vat, with the result that draining of the body of bituminous material from the supply pipe is relatively gradual. Since asphalt of the type which is generally used in the forming of building roofs of the above type solidifies at a temperature of about 150° F. the body of bituminous material within the supply pipe, or at least a portion thereof, may solidify, with again the need for this bituminous material to be removed before the supply of bituminous material to the roof can be recommenced.

It is a primary object of the present invention to provide apparatus for supplying molten bituminous material in which the above-described disadvantage of the above forms of apparatus as hitherto used is substantially obviated or mitigated.

According to the present invention there is provided apparatus for supplying molten bituminous material, the apparatus comprising a vat for bituminous material, a heater within the vat for melting the bituminous material, a pump having an inlet and an outlet with the inlet being disposed within the vat, a valve having first, second, third and fourth ports, and an upstanding supply pipe having a lower end in communication with the second port of the valve and an upper end disposed at an elevated level. The first port is in communication with the outlet of the pump, and the third and fourth ports are in communication with the interior of the vat, with the fourth port being disposed at a lower level than the second port. The valve has a valve member movable between a first condition in which the first port is in communication through the valve with the second port, and a second condition in which the first port is in communication through the valve with the third port and the second port is in communication through the valve with the fourth port for drainage under gravity of molten bituminous material from the supply pipe through the second port and the fourth port back to the vat.

Figure 2:
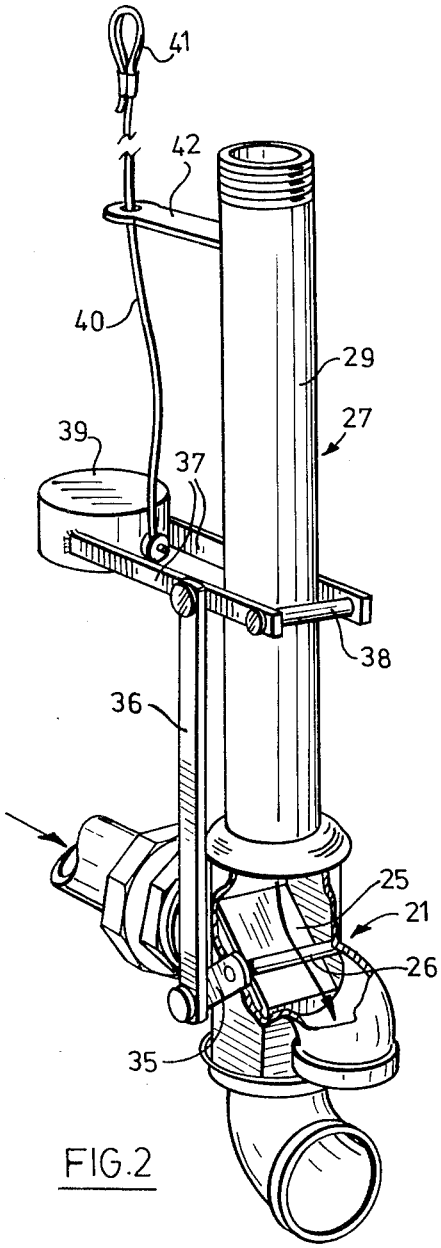
Figure 3:
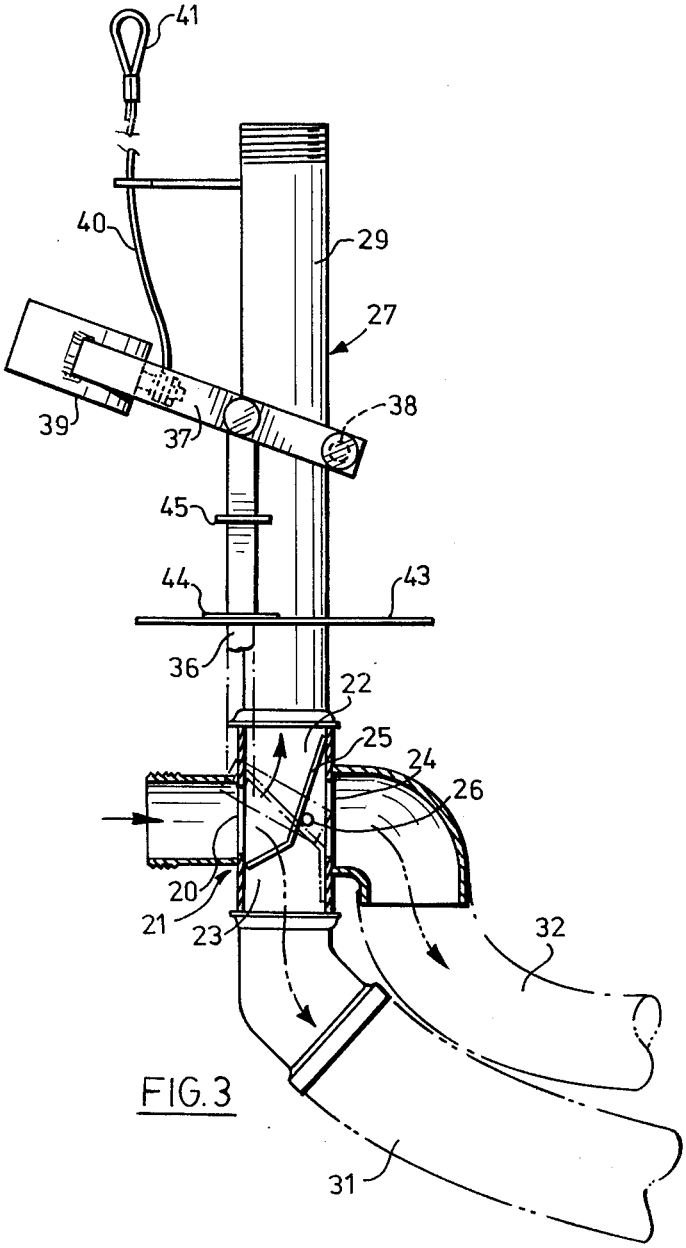

In order that the invention may be more clearly understood and more readily carried into effect the same will now, by way of example, be more fully described with reference to the accompanying drawing in which FIG. 1 is a somewhat diagrammatic view of apparatus according to a preferred embodiment of the invention;

FIG. 2 is a partially broken away view of part of the apparatus shown in FIG. 1; and FIG. 3 is a side view, partly in section, of the part of the apparatus shown in FIG. 2, but in a different operative condition.

Referring to the drawing, 10 denotes generally a building which may be a single storey or multi-storey building and which has a roof 11 of flat, horizontal form. 12 denotes a vat which is shown as being provided adjacent one end thereof with wheels 13 to facilitate transportation of the vat 12. Adjacent the opposed end of the vat 12 there are provided support legs 14 to support the vat 12 on the ground 15 in a substantially horizontal condition.

Disposed within the vat 12 preferably adjacent the bottom thereof is heater means 16 which may, for example, be oil or gas-fired or electrically energized. The heater means 16 serves to melt bituminous material which is loaded into the vat 12 and to heat this molten bituminous material to a temperature of approximately 450° F. (230° C.).

Also provided within the vat 12 is a pump 17 which may be of conventional form and may be operatively driven by, for example, a gasoline or diesel engine or an electric motor (not shown). The pump 17 which is disposed below the normal level of the molten bituminous material within the vat 12 so that the heat of this molten bituminuous material within the vat 12 prevents solidification of the bituminous material operatively being pumped through the pump 17 has an inlet 18 and an outlet 19, at least the inlet 18 being disposed within the vat 12 below the normal level of the molten bituminous material therein.

The outlet 19 of the pump 17 is in communication with a first port 20 of a valve 21 which is more clearly shown in FIGS. 2 and 3. Referring to these views of the drawing, the valve 21 has, in addition to the first port 20, a second port 22, a third port 23 and a fourth port 24. The valve 21 incorporates a valve member 25 which in the preferred embodiment of the invention shown in the accompanying drawing comprises a plate fixedly secured to a horizontally disposed pivot pin 26, the plate 25 being of rectangular form and comprising two relatively inclined portions, with the valve 21 within which the plate 25 is disposed being of rectangular, such as square, form in internal horizontal cross-section. The ends of the pin 26 project through the appropriate side walls of the valve 21 and are connected to a linkage mechanism operation of which controls movement of the valve member plate 25 between a first condition (shown in full lines in FIG. 3) in which the port 20 is in communication through the valve with the port 22 and the port 23 is in communication through the valve with the port 24, and a second condition (shown in FIG. 2, and shown in chain-dotted lines in FIG. 3) in which the port 20 is in communication through the valve with the port 23 and the port 22 is in communication through the valve with the port 24. An upstanding supply pipe 27 is provided with the lower end thereof mounted in communication with the second port 22 of the valve 21, and with the upper end 28 thereof disposed at an appropriate elevated level for discharge therefrom of molten bituminous material onto the roof 11 of the building 10. As shown in the drawing, the supply pipe 27 comprises a lower section 29 and an upper section 30 which is screw-threadedly connected to the lower section 29. It will, of course, be appreciated that the upper section 30 may itself comprise a plurality of interconnected sections particularly if the building 10 is a multi-storey building. Pipes 31 and 32 are connected to the valve 21 in communication with the ports 23 and 24, respectively, the remote ends 33 and 34 of these pipes 31 and 32, respectively, being disposed within the vat 12 at the end thereof remote from the inlet 18 of the pump 17, as is clearly shown in FIG. 1.

The linkage mechanism for operation of the valve member plate 25 between the first and second conditions thereof comprises links 35 one end of each of which is secured to a respective end of the pivot pin 26, and the other end of each of which is pivotally connected to the lower end of a respective link 36. The upper ends of these links 36 are each pivotally connected between the ends of a respective link 37 one end of each of which is pivotally mounted on a respective end of a pivot pin 38 which is secured as by welding to the lower section 29 of the supply pipe 27, the other ends of the links 37 being secured to a weight 39 with one end of a flexible member 40 such as a cable or rope being secured to the weight 39 and the other end of the flexible member 40 being provided with a handle portion 41 disposed at the level of the roof 11 of the building 10. The flexible member 40 may be disposed through a guide bracket 42 secured to the lower section 29 of the supply pipe 27.

The links 36 pass through slots provided in a horizontal plate 43 (FIG. 3) which is mounted on the lower section 29 of the supply pipe 27, reinforcement plates 44 being secured on the plate 43 around the slots therein and abutment plates 45 being mounted on the links 36 for abutting engagement with the plates 44 thereby to limit downward movement of the links 36 through the plate 43. In this manner any risk of damage to the valve member plate 25 as it is pivotally moved into the second condition thereof is substantially avoided.

In operation, pulling on the handle portion 41 of the flexible member 40 by a workman located on the roof 11 of the building 10 causes, through operation of the linkage mechanism comprising the links 35, 36 and 37, the valve member plate 25 pivotally to move to the above-described first condition thereof. With the plate 25 in this first condition thereof, molten bituminous material is pumped by the pump 17 through the valve 21 from the port 20 to the port 22, and thence is supplied up the supply pipe 27 to the upper end 28 thereof for discharge as required on the roof 11. When it is desired temporarily to discontinue the supply of molten bituminous material to the roof 11 the workman releases the flexible member 40 so that under the influence of the weight 39 the linkage mechanism causes the plate 25 pivotally to move to the second condition thereof. With the plate 25 in this second condition thereof, the molten bituminous material is pumped by the pump 17 through the valve 21 from the port 20 to the port 23, and thence through the pipe 31 for recycling into the vat 12, the pump 17 running continuously while the molten bituminous material is being supplied to the roof 11 and while this supply is temporarily discontinued.

Furthermore, with the plate 25 in the second condition thereof the body of molten bituminous material within the upstanding supply pipe 27 is freely drained under gravity through the ports 22 and 24 of the valve 21 and through the pipe 32 back to the vat 12, the port 24 being disposed at a lower level than the port 22. Because of this free draining under gravity of the body of molten bituminous material in the supply pipe 27 when the plate 25 is pivotally moved from the first condition to the second condition thereof cooling of the bituminous material within the pipe 27 such as to cause solidification thereof is substantially avoided.

By disposing the discharge end 33 of the pipe 31 substantially at the end of the vat 12 remote from the inlet 18 of the pump 17 and preferably adjacent the bottom of the vat 12 good circulation of the molten bituminous material within the vat 12 is achieved, thereby ensuring faster overall heating of the bituminous material within the vat 12 and a substantially uniform temperature of this bituminous material within the vat 12.

What we claim is:

1. Apparatus for supplying molten bituminous material, the apparatus comprising a vat for bituminous material, a heater within the vat for melting the bituminous material, a pump having an inlet and an outlet with the inlet being disposed within the vat, a valve having first, second, third and fourth ports, an upstanding supply pipe having a lower end in communication with the second port of the valve and an upper end disposed at an elevated level, the first port being in communication with the outlet of the pump, and the third and fourth ports being in communication with the interior of the vat, with the fourth port being disposed at a lower level than the second port, and a valve member movable between a first condition in which the first port is in communication through the valve with the second port, and a second condition in which the first port is in communication through the valve with the third port and the second port is in communication through the valve with the fourth port for drainage under gravity of molten bituminous material from the supply pipe through the second port and the fourth port back to the vat.

2. Apparatus according to claim 1, wherein the third port of the valve communicates with the interior of the vat at a location remote from the inlet of the pump.

3. Apparatus according to claim 1, wherein the valve member comprises a plate pivotally mounted within the valve.

4. Apparatus according to claim 3, wherein a linkage mechanism is connected to the pivotally mounted plate, a flexible member being provided with one end thereof connected to the linkage mechanism and the other end thereof disposed at said elevated level for controlling from said elevated level movement of the valve member from said second condition to said first condition thereof, and a weight being mounted on the linkage mechanism for urging movement of the valve member from said first condition to said second condition thereof.

* * * * *